US007071236B2

(12) United States Patent
Fischer et al.

(10) Patent No.: US 7,071,236 B2
(45) Date of Patent: Jul. 4, 2006

(54) NATURAL GAS LIQUEFACTION AND CONVERSION METHOD

(75) Inventors: Béatrice Fischer, Lyons (FR); Alexandre Rojey, Rueil Malmaison (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 0 days.

(21) Appl. No.: 10/964,689

(22) Filed: Oct. 15, 2004

(65) Prior Publication Data

US 2005/0113468 A1 May 26, 2005

(30) Foreign Application Priority Data

Oct. 16, 2003 (FR) ..... 03 12093

(51) Int. Cl.
*C07C 27/00* (2006.01)
*F25J 1/00* (2006.01)
*F25J 3/00* (2006.01)

(52) U.S. Cl. ..... 518/700; 62/611; 62/613; 62/619; 62/620

(58) Field of Classification Search ..... 518/700; 62/611, 613, 619, 620
See application file for complete search history.

(56) References Cited

U.S. PATENT DOCUMENTS 6,248,794 B1 6/2001 Gieskes
2003/0136146 A1 7/2003 Fischer-Calderson

FOREIGN PATENT DOCUMENTS

EP 1 306 632 A1 5/2003
WO WO 98/36038 8/1998

*Primary Examiner*—J. Parsa
(74) *Attorney, Agent, or Firm*—Antonelli, Terry, Stout and Kraus, LLP.

(57) ABSTRACT

The natural gas flowing in through line 1 is cooled, then expanded in turbine T1. The liquid at the bottom of drum D2 is the liquefied natural gas. The gas at the top of drum D2 is compressed by compressor K1, then fed into the treating plant using a Fischer-Tropsch process to convert the natural gas to natural gas liquid.

8 Claims, 4 Drawing Sheets

FT
K2
T2
K1
D3
P2
D1
P1
V1
E3
C2
C1
V10
D2
E1
E2
T1
1
2
3
4
5
10
11
13
14
15
16
17
18
19
20
21
22
23
24
30
R1
R2

NATURAL GAS LIQUEFACTION AND CONVERSION METHOD

FIELD OF THE INVENTION

The present invention relates to the field of conversion of natural gas to liquid products. More particularly, the present invention provides a method allowing a natural gas to be liquefied by cooling using synergism with the Fischer-Tropsch process.

What is referred to as natural gas is a gaseous, liquid or two-phase mixture comprising at least 50% methane, and possibly other hydrocarbons and nitrogen. Natural gas is generally produced in gaseous form, and at a high pressure ranging for example between 2 MPa and 15 MPa.

Natural gas is commonly produced in sites remote from the places where it is intended to be used. It is a common procedure to convert the gas to liquid so as to transport it over very long distances, for example by means of LNG carriers. Natural gas can be liquefied at very low temperatures. Natural gas can also be reformed to synthesis gas, then converted to liquid paraffins by means of the Fischer-Tropsch process.

BACKGROUND OF THE INVENTION

There are many natural gas liquefaction methods.

In particular, U.S. Pat. No. 6,105,389 describes a liquefaction method using two coolant circuits. Although it is effective, this method requires a large amount of energy, and therefore implementation of very expensive gas turbines.

U.S. Pat. No. 6,449,982 describes a liquefaction method allowing to liquefy only part of the gas treated. The power required for liquefaction is therefore reduced. However, a drawback of this method lies in the use of the excess gas, insofar as the liquefaction site is often far from the places of use.

U.S. Pat. No. 6,248,794 describes various integrations of a Fischer-Tropsch process with a natural gas liquefaction method. In particular, it proposes using the residual gas from the Fischer-Tropsch process in the gas turbines operating the refrigeration compressors, or using steam turbines to operate the refrigeration compressors, the steam being produced in the Fischer-Tropsch unit.

The present invention provides a method allowing to best upgrade all of the natural gas from an oil well by proposing integration of a low-temperature liquefaction method and of a Fischer-Tropsch process.

SUMMARY OF THE INVENTION

In general terms, the present invention relates to a natural gas liquefaction and conversion method wherein the following stages are carried out:

a) cooling, then distilling the natural gas so as to obtain a scrubbed natural gas and natural gas liquids, b) liquefying at least partly the scrubbed natural gas, c) expanding at least part of the partly liquefied natural gas obtained in stage b) so as to obtain a gas fraction and a liquid fraction, d) compressing part of the gas fraction obtained in stage c), e) expanding, then distilling the natural gas liquids obtained in stage a), f) converting, by means of a Fischer-Tropsch process, the compressed gas obtained in stage d) and the vapors resulting from distillation in stage e) to a product comprising at least five carbon atoms per molecule.

According to the invention, the following stage can be carried out:

g) liquefying at least partly the scrubbed natural gas obtained in stage a) so as to obtain a gas phase and a liquid phase, a first part of the gas phase being converted by means of the Fischer-Tropsch process, a second part of the gas phase forming the natural gas of stage a).

According to the invention, in stage b), the natural gas can be cooled by heat exchange with the gas fraction obtained in stage c). In stage b), it is also possible to cool the natural gas by heat exchange with a coolant circulating in a circuit using a compressor. The compressor can be operated by a steam turbine, the steam being produced by the Fischer-Tropsch process, or the compressor can be operated by an electric motor, the electricity being supplied by an electric generator operated by a steam turbine, the steam being produced by the Fischer-Tropsch process.

According to the invention, the following stages can be carried out:

h) expanding the liquid fraction obtained in stage c) so as to obtain a second gas fraction and a second liquid fraction, and i) cooling the liquid fraction obtained in stage c) by heat exchange with the second gas fraction obtained in stage h).

According to the invention:

the natural gas can be at a pressure ranging between 2 MPa and 15 MPa, in stage c), expansion can be carried out up to a pressure ranging between 0.1 MPa abs. and 1 MPa abs., in stage d), compression can be carried out up to a pressure ranging between 0.5 MPa abs. and 5 MPa abs.

In general, the pressure of the natural gas at the process inlet is higher than the pressure of the gas that is converted by means of the Fischer-Tropsch process. According to the invention, this pressure difference is advantageously used to cool the natural gas by expansion.

BRIEF DESCRIPTION OF THE FIGURES

Other features and advantages of the invention will be clear from reading the description hereafter, with reference to the accompanying drawings wherein.

DETAILED DESCRIPTION

Figure 1:
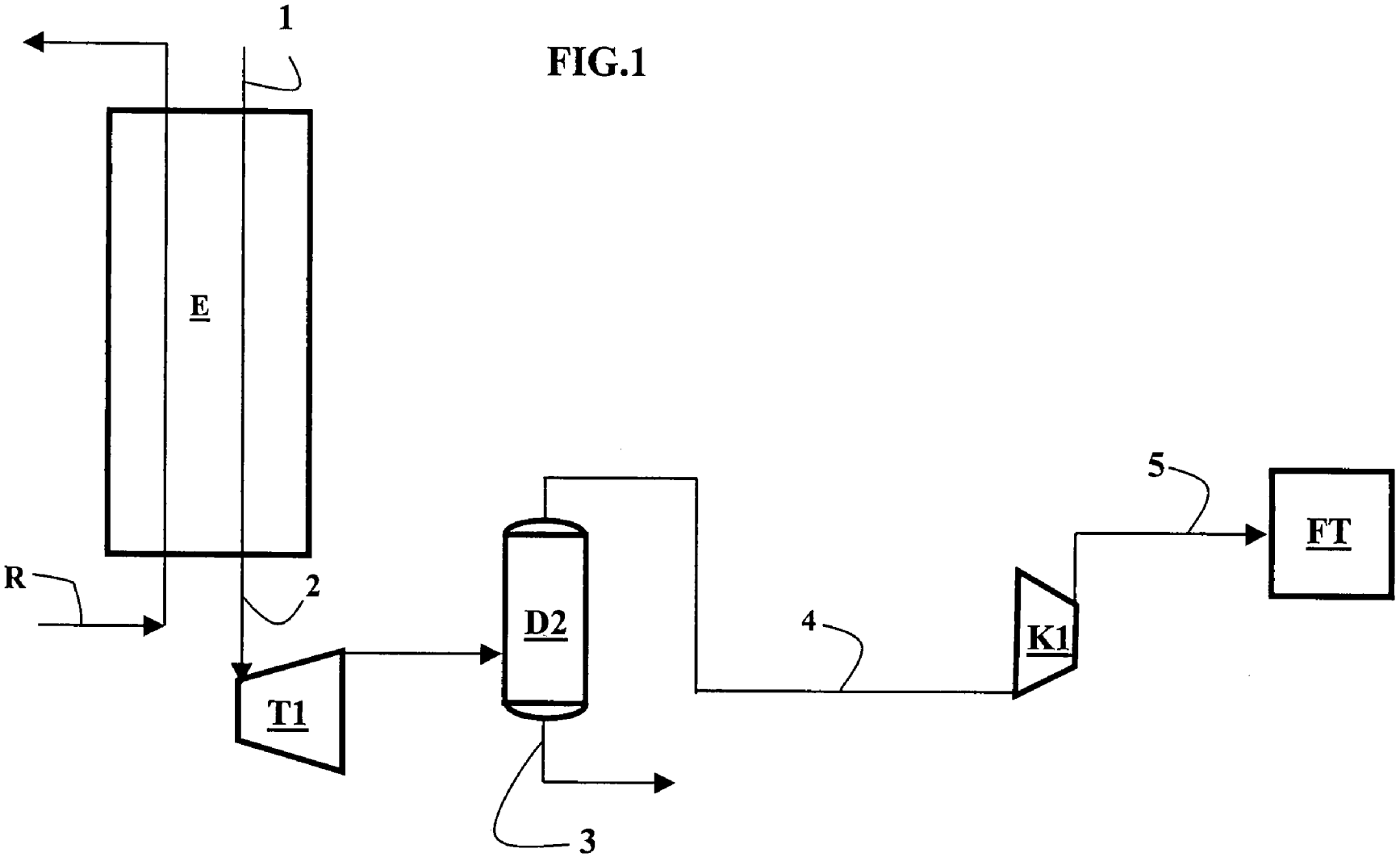
FIG. 1 diagrammatically shows the method according to the invention.

In FIG. 1, the natural gas flowing in through line 1 is cooled in heat exchanger E. Line R carries the coolant into exchanger E. The natural gas flows out of exchanger E partly or totally liquefied through line 2, then it is fed into expansion means T1. Expansion means T1 can be a valve, a turbine or an association of a turbine and of a valve. The expansion carried out by means T1 is performed up to a sufficiently low pressure, for example ranging between 0.1 MPa abs. and 1 MPa abs., so that the expanded natural gas comprises a gas fraction and a liquid fraction. Preferably, the natural gas is expanded down to a pressure close to atmospheric pressure.

The natural gas from expansion means T1 is fed into separation means D2, a separating drum for example. Separation means D2 allows the gas fraction to be separated from the liquid fraction.

The liquid fraction from separation means D2 forms the liquefied natural gas, which can be sent through line 3 to a cryogenic storage site.

The vapour fraction from separation means D2 is sent through line 4 to compressor K1, which compresses this fraction to a sufficient pressure, ranging for example between 0.5 MPa and 5 MPa, to supply unit FT using a Fischer-Tropsch process. Line 5 brings the compressed vapour fraction to unit FT.

The Fischer-Tropsch process was first used in the 30s in Germany, and has been used commercially since the 50s in South Africa. This process appears to be the most promising, notably for upgrading natural gas produced in places very far away from the sites of use. However, the process is highly exothermic and works in a limited temperature range. It is common practice to discharge the heat from the reactor by producing a large amount of steam, which is not easy to use in often faraway natural gas production sites.

In the present description, the term FT or Fischer-Tropsch process designates the stages for producing liquid hydrocarbons, at atmospheric pressure and at ambient temperature, from natural gas. These stages are well known to the man skilled in the art. The first stage consists in converting methane in the presence of water at high temperature to produce a synthesis gas (or syngas) made up of carbon monoxide and hydrogen. A second stage uses a suitable catalyst for producing long-chained hydrocarbons from the synthesis gas obtained in the first stage. This second stage is generally referred to as Fischer-Tropsch synthesis or Fischer-Tropsch reaction.

The Fischer-Tropsch process is notably mentioned in the following documents U.S. Pat. No. 6,596,667 and U.S. Pat. No. 6,348,510.

Figure 2:
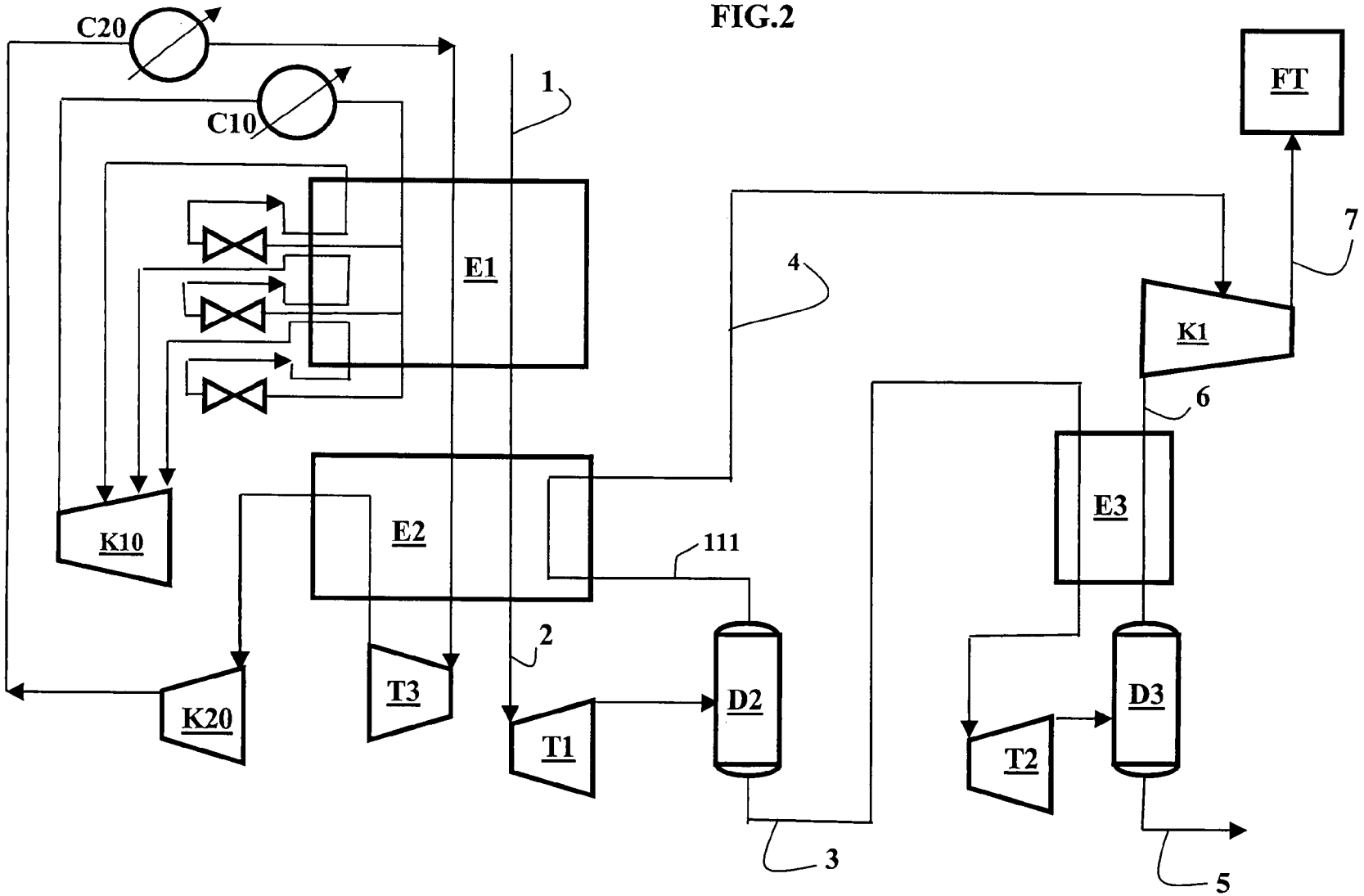
FIGS. 2, 3 and 4 show variants of the method according to the invention.

In FIG. 2, the natural gas flowing in through line 1 is cooled in heat exchangers E1 and E2 by a first and a second cooling mixture.

A first cooling mixture, preferably consisting of propane and ethane, is compressed by compressor K10, then condensed in heat exchanger C10. Then, this first mixture is supercooled in exchanger E1, expanded to three different pressure levels prior to being totally vaporized by heat exchange in E1. Finally, the first cooling mixture is sent back to compressor K10.

A second cooling mixture, preferably consisting of methane and ethane, is compressed by compressor K20, cooled by heat exchanger C20, condensed in heat exchanger E1, supercooled in heat exchanger E2 and expanded in expander T3 (valve and/or turbine). Then, the second cooling mixture is vaporized by heat exchange in E2, then sent back to compressor K20.

The natural gas leaves exchanger E2, partly or totally liquefied, through line 2, then it is fed into expansion means T1. The natural gas is expanded so as to produce a liquid fraction and a gas fraction. The liquid and gas fractions are separated in separator D2.

The gas fraction coming from drum D2 through line 111 can be used as coolant in heat exchanger E1 and/or E2, then sent through line 4 into compressor K1 to be compressed.

The liquid fraction coming from drum D2 through line 3 is cooled in heat exchanger E3, then expanded by expansion means T2 so as to produce a gas fraction and a liquid fraction. The gas and liquid fractions are separated in separator D3.

The liquid fraction discharged through line 5 forms the liquefied natural gas.

The gas fraction discharged from separator D3 is used as coolant in heat exchanger E3, then it is sent through line 6 into compressor K1 to be compressed.

The compressed natural gas coming from compressor K1 through line 7 is sent to unit FT using a Fischer-Tropsch process.

The method described in connection with FIG. 3 proposes carrying out the invention by scrubbing of the natural gas and recovery of the natural gas liquids.

Figure 3:
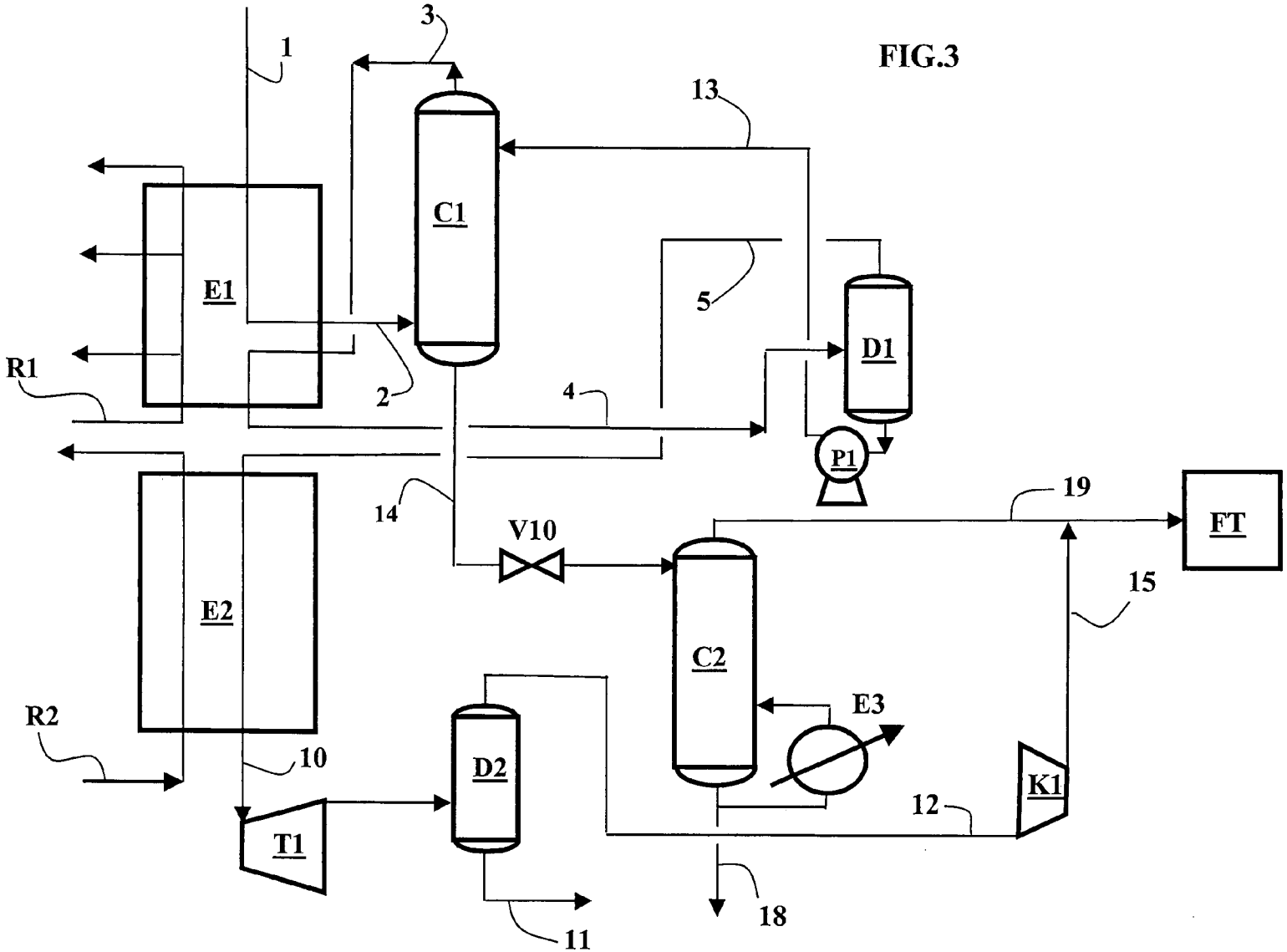

In FIG. 3, the natural gas flowing in through line 1 is cooled in heat exchanger E1 to a temperature preferably ranging between 0° C. and −50° C. Exchanger E1 is cooled by cooling circuit R1.

The cooled gas is sent through line 2 to the bottom of distillation column C1. A liquid colder than the gas is sent through line 13 to the top of column C1, so as to condense the heavier compounds contained in the natural gas. These condensates are discharged from the bottom of column C1 through line 14.

A scrubbed natural gas, i.e. at least partly freed of the heavier constituents, is discharged from the top of column C1 through line 3, then sent to heat exchanger E1 to be cooled again. The natural gas is discharged from exchanger E1 through line 4, partly condensed.

The partly condensed natural gas is sent through line 4 into separator D1 to separate the liquid fraction from the gas fraction.

The liquid fraction coming from the bottom of separator D1 is sent through pump P1 to the top of column C1 by means of line 13.

The gas fraction coming from D1 is sent through line 5 to heat exchanger E2 to be condensed. Exchanger E2 is cooled by cooling circuit R2.

The natural gas flows out of exchanger E2 through line 10, at least partly liquefied and preferably totally liquefied. The natural gas is carried through line 10 to expansion device T1 in order to be expanded so as to produce a gas fraction and a liquid fraction. After expansion, the liquid and gas fractions are fed into separating drum D2 which is at a pressure preferably close to the atmospheric pressure.

The liquid fraction at the bottom of drum D2 forms the liquefied natural gas, which can be sent through line 11 to a cryogenic storage site.

The gas fraction at the top of drum D2 is sent through line 12 to compressor K1. The compressed gas fraction is discharged from compressor K1 through line 15.

The condensates obtained at the bottom of distillation column C1 through line 14 are expanded through valve V10, then fed into distillation column C2 to be stabilized. Exchanger E3 allows heat to be supplied at the bottom of column C2.

The natural gas liquids comprising notably propane and butane are discharged from the bottom of column C2 through line 18.

The revaporized natural gas comprising mainly methane is discharged from the top of column C2 through line 19.

The gas circulating in lines 15 and 19 is sent to unit FT using a Fischer-Tropsch process.

During cooling of the natural gas, the heavier constituents contained in the natural gas are generally separated, in particular the LPGs consisting of propane and butane, as well as the fraction comprising the hydrocarbons with more than five carbon atoms (C5+). These fractions are upgraded separately. Such a configuration is given in the description of a method in connection with FIG. 4, and illustrated by a numerical example.

A natural gas at a pressure of 5.5 MPa and at a temperature of 30° C. is sent through line 1 into heat exchanger E1. The composition in percent by mole of the natural gas is as follows:

| | |
|---|---|
| Nitrogen | 0.2% |
| Methane | 85% |
| Ethane | 7% |
| Propane | 4% |
| Isobutane | 2% |
| N-butane | 1% |
| C5+ | 0.8% |

The natural gas is cooled in exchanger E1 down to −25° C. It is then sent to the bottom of distillation column C1 through line 2. The natural gas undergoes, in column C1, absorption of the heavier compounds by a liquid fed to the top of column C1 through line 13 at −50° C. The liquid obtained at the bottom of column C1 is sent through line 14 into valve V10 to be expanded, then to condensate stabilization column C2.

The scrubbed gas flowing through line 3 from the top of column C1 is sent to heat exchanger E1 where it is cooled to −50° C. At this temperature, the gas is partly liquefied. This gas-liquid mixture is sent through line 4 into drum D1, where the liquid and gas fractions are separated. The liquid obtained at the bottom of drum D1 is separated into two parts.

Part of the liquid is sent through pump P1 and line 13 into column C1 to scrub the natural gas flowing in through line 2. Another part of the liquid is discharged through line 30, expanded by valve V1, then fed into condensate stabilization column C2.

The gas fraction obtained at the top of drum D1 comprises 93% methane, 5.2% ethane and less than 1.7% propane and products heavier than propane. This gas is separated into two fractions. A first fraction of the gas is sent through line 5 to exchanger E2 to be cooled and liquefied. The liquefied natural gas obtained at the outlet of exchanger E2 is sent through line 10 into expansion turbine T1, then fed into drum D2 at a pressure close to the atmospheric pressure. The liquid fraction collected at the bottom of drum D2 forms the liquefied natural gas, which can be sent through line 11 to a storage site. The gas fraction obtained at the top of drum D2 is sent through line 21 into compressor K1. The compressed gas is discharged through line 22.

The second fraction of the gas from drum D1 is sent through line 15 into turbine T2 to be expanded to a pressure of 2.71 MPa. A liquid fraction is formed upon expansion. The mixture obtained at the outlet of turbine T2 is sent through line 16 into drum D3 where the liquid and gas fractions are separated. The liquid fraction obtained at the bottom of drum D3 is sent by means of pump P2 and of line 17 into column C2.

Heat exchanger E3 allows to reboil the liquid phase at the bottom of column C2 and to vaporize the methane present in column C2. At the bottom of column C2, the natural gas liquid is discharged through line 24. This natural gas liquid consists of 28.4% by mole of ethane, 33.1% propane, 29.8% butanes, and 8.4% pentanes and heavier compounds.

The vapour collected at the top of column C2 through line 19 is mixed with the gas fraction coming from drum D3 through line 18. This gas mixture is at a temperature of −77° C. and at a pressure of 2.7 MPa. It is heated in exchanger E2, then E1 up to 25° C. It is then sent through line 20 into compressor K2 which can be operated by the energy recovered by expansion turbine T2. The compressed gas from compressor K2 is mixed with the gas coming from compressor K1 through line 22. The gas mixture is sent through line 23 into unit FT using a Fischer-Tropsch process.

The natural gas is cooled in heat exchangers E1 and E2 on the one hand by the cold gas flowing in through lines 18 and 19, and on the other hand by cooling circuits R1 and R2 which respectively cool exchangers E1 and E2.

According to the method described in connection with FIG. 4, with a flow rate of 27 000 Kmole/h of natural gas flowing in through line 1, a flow rate of 11 930 Kmole/h of liquefied gas discharged through line 11 is produced, a flow rate of 12 525 Kmole/h of gas is sent to unit FT and a flow rate of 2545 Kmole/h of natural gas liquid is discharged through line 24. The power required for the two cooling circuits R1 and R2 is 49.93 MW. The power of compressor K1 is 6.5 MW. This total power corresponds to the power available in the form of vaporized water produced by unit FT treating a gas flow rate of 12 525 Kmole/h. Thus, the energy required for the two cooling circuits R1 and R2 and for compressor K1 can come from unit FT. Consequently, according to the invention, 1.8 million tons of liquid natural gas and 1 million tons of natural gas liquid can be produced according to the invention, using no or little energy supplied by an exterior source.

According to the invention, a first part of the natural gas to be treated is liquefied by cooling, a second part of the natural gas to be treated is liquefied by means of the Fischer-Tropsch process. The composition of the first part is different from that of the second part: during the method according to the invention, the first part is enriched in heavy compounds, notably hydrocarbons heavier than methane, whereas the second part is enriched in light compounds, notably methane and nitrogen.

For example, in connection with FIG. 1, the liquid fraction discharged through line 3 notably comprises hydrocarbons heavier than methane whereas the gas fraction discharged through line 5 mainly comprises methane and nitrogen.

In connection with FIG. 2, the liquid fraction discharged through line 5 notably comprises hydrocarbons heavier than methane whereas the gas fraction discharged through line 7 mainly comprises methane and nitrogen.

In connection with FIG. 3, the liquid fraction discharged through line 11 mainly comprises methane and ethane, and the liquid fraction discharged through line 18 mainly comprises propane and butane, whereas the gas fractions discharged through lines 15 and 19 mainly comprise methane and nitrogen.

Figure 4:
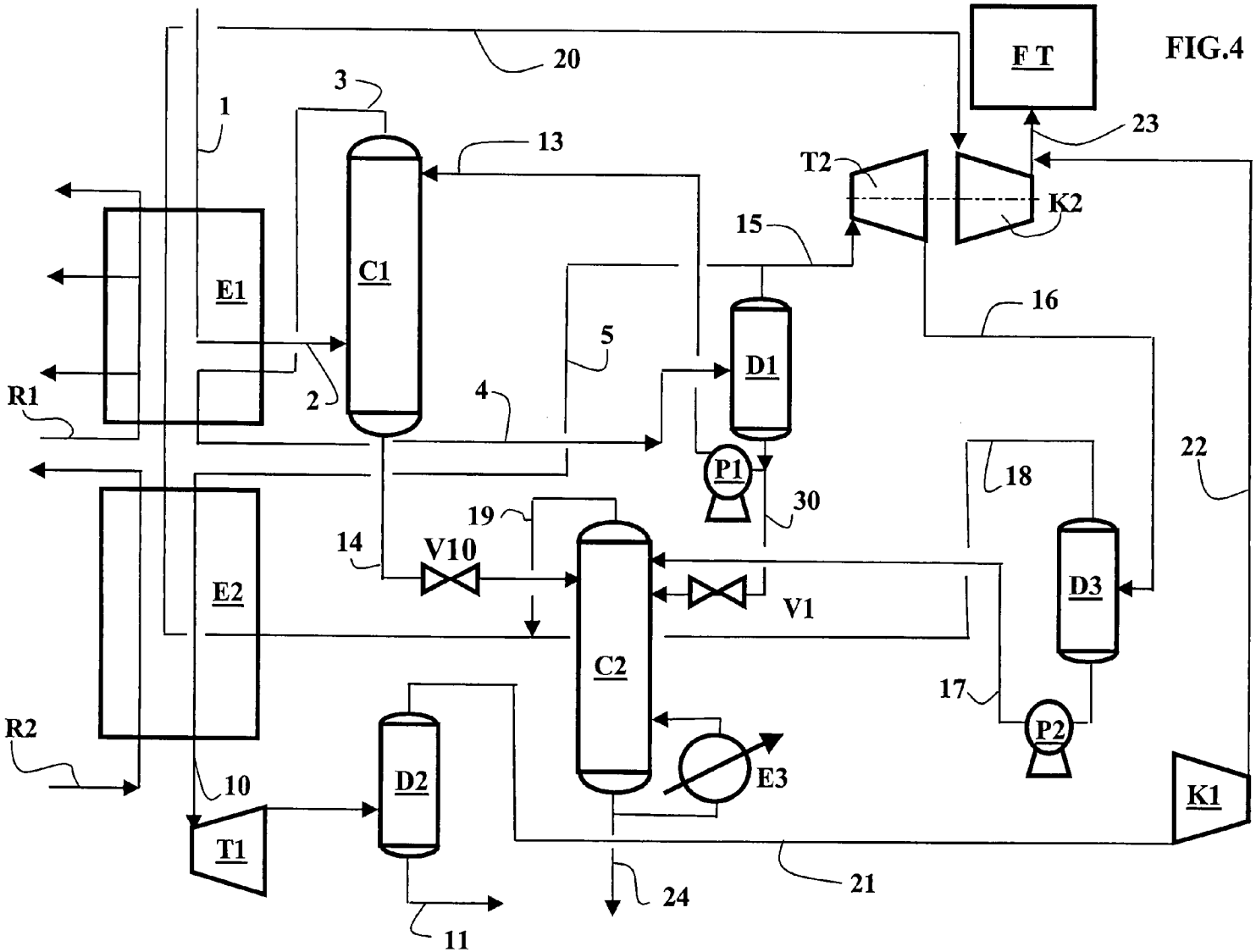

In connection with FIG. 4, the liquid fraction discharged through line 11 mainly comprises methane and ethane, and the liquid fraction discharged through line 24 mainly comprises propane and butane, whereas the gas fractions discharged through lines 20 and 22 mainly comprise methane and nitrogen.

The fact that the second part of the gas, liquefied by means of the Fischer-Tropsch process, is enriched in light constituents such as methane and nitrogen is advantageous. In fact, the presence of nitrogen in the natural gas liquefied by cooling must be strictly limited, but the presence of nitrogen in moderate amount does not hinder the Fischer-Tropsch conversion process. Furthermore, the fact that the first part of the gas is enriched in heavy compounds gives the natural gas liquefied by cooling a higher calorific value than a liquefied natural gas mainly comprising methane.

In general, the pressure at which the Fischer-Tropsch process is carried out is lower than the pressure at which the liquefaction unit is operated. This pressure difference is turned to good account in the method according to the invention, for example in the method described in connection with FIG. 4, to partly liquefy the natural gas by expansion through a turbine. Such a layout allows to continue separation between the light constituents such as methane and nitrogen, and the heavier constituents.

After expansion and vaporization, the coolants circulating in cooling circuits R of FIG. 1, of cooling circuits R1 and R2 of FIGS. 3 and 4, are compressed. Similarly, the first and second coolants used in the method described in connection with FIG. 2 are compressed by compressors K10 and K20 after expansion and vaporization.

Advantageously, according to the invention, the energy required for this recompression of the coolant(s) can come, at least partly, from the Fischer-Tropsch process. In fact, this process is exothermic and the heat produced during the reaction can be used to produce steam.

The steam thus produced can be expanded in turbines that drive the compressors used to compress the coolants.

The steam can also be expanded in turbines driving an alternator. The electricity thus produced can be used to supply electric motors feeding the compressors used for compression of the coolants.

Although the present invention has been described within the context of particular embodiment examples, it is clear that it is not limited to these examples and that it can be subjected to variants or changes without departing from the scope thereof.

The invention claimed is:

1. A natural gas liquefaction and conversion method, wherein the following stages are carried out:

a) cooling, then distilling the natural gas so as to obtain a scrubbed natural gas and a liquid, b) liquefying at least partly the scrubbed natural gas, c) expanding at least part of the partly liquefied natural gas obtained in stage b) so as to obtain a gas fraction and a liquid fraction, d) compressing part of the gas fraction obtained in stage c), e) expanding, then distilling the liquid obtained in stage a) so as to obtain a vapor and natural gas liquids, f) converting, by means of a Fischer-Tropsch process, the compressed gas obtained in stage d) and the vapors resulting from distillation in stage e) to a product comprising at least five carbon atoms per molecule.

2. A method as claimed in claim 1, wherein the following stage is carried out:

a) liquefying at least partly the scrubbed natural gas obtained in stage a) so as to obtain a gas phase and a liquid phase, a first part of the gas phase being converted by means of the Fischer-Tropsch process, a second part of the gas phase forming the natural gas of stage a).

3. A method as claimed in claim 1 wherein, in stage b), the natural gas is cooled by heat exchange with the gas fraction obtained in stage c).

4. A method as claimed in claim 1 wherein, in stage b), the natural gas is cooled by heat exchange with a coolant circulating in a circuit using a compressor.

5. A method as claimed in claim 4, wherein the compressor is operated by a steam turbine, the steam being produced by the Fischer-Tropsch process.

6. A method as claimed in claim 4, wherein the compressor is operated by an electric motor, the electricity coming from an electric generator operated by a steam turbine, the steam being produced by the Fischer-Tropsch process.

7. A method as claimed in claim 1, wherein the following stages are carried out:

h) expanding the liquid fraction obtained in stage c) so as to obtain a second gas fraction and a second liquid fraction, and i) cooling the liquid fraction obtained in stage c) by heat exchange with the second gas fraction obtained in stage h).

8. A method as claimed in claim 1, wherein:

a) the natural gas is at a pressure ranging between 2 MPa and 15 MPa, b) in stage c), expansion is carried out up to a pressure ranging between 0.1 MPa abs. and 1 MPa abs., c) in stage d), compression is carried out up to a pressure ranging between 0.5 MPa abs. and 5 MPa abs.

* * * * *